United States Patent [19]

Sevastakis

[11] 4,180,122

[45] Dec. 25, 1979

[54] COMPOSITE PINCH ROLL FOR CONTINUOUS VERTICAL CASTING

[76] Inventor: Gus Sevastakis, 5645 Angola Rd., Toledo, Ohio 43615

[21] Appl. No.: 904,471

[22] Filed: May 10, 1978

[51] Int. Cl.[2] ..... B22D 11/12

[52] U.S. Cl. ..... 164/448; 29/116 R; 29/125; 226/110; 226/189

[58] Field of Search ..... 164/441, 442, 447, 448; 29/124, 125, 116 R; 226/110, 189; 72/221

[56] References Cited

U.S. PATENT DOCUMENTS

| | | | |
|---|---|---|---|
| 177,424 | 5/1876 | Richards | 29/125 X |
| 767,268 | 8/1904 | Felsing, Jr. | 29/125 X |
| 1,428,142 | 9/1922 | Canda | 29/125 X |
| 3,447,351 | 6/1969 | Werntz | 29/125 X |

FOREIGN PATENT DOCUMENTS

| | | | |
|---|---|---|---|
| 184312 | 1/1956 | Fed. Rep. of Germany | 164/448 |
| 1451917 | 7/1966 | France | 164/448 |

*Primary Examiner*—Robert D. Baldwin
*Assistant Examiner*—J. Reed Batten, Jr.
*Attorney, Agent, or Firm*—William E. Mouzavires

[57] ABSTRACT

A pinch roll for use in vertical casting of bar stock or products, has a main body portion and opposite side portions removably fixed to the main body portion. The main body portion is utilized in a single bar casting operation, whereas the opposite side portions are utilized in a double bar casting operation. The side portions may be fixed to the main body portion in one of two alternate positions depending on the distance between the casting lines in a double bar casting operation; the distance being governed by the size of a crucible which is utilized for holding the molten material, usually metal, which is to be cast into the bars.

11 Claims, 6 Drawing Figures

FIG. 3
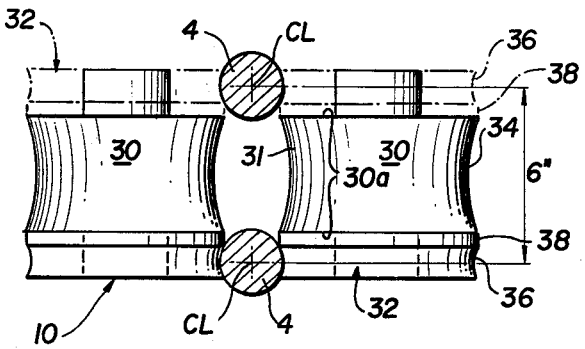
FIG. 4
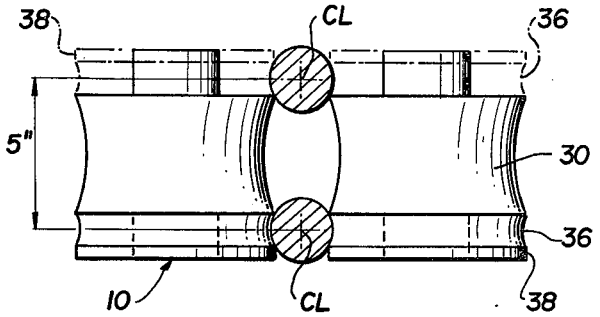
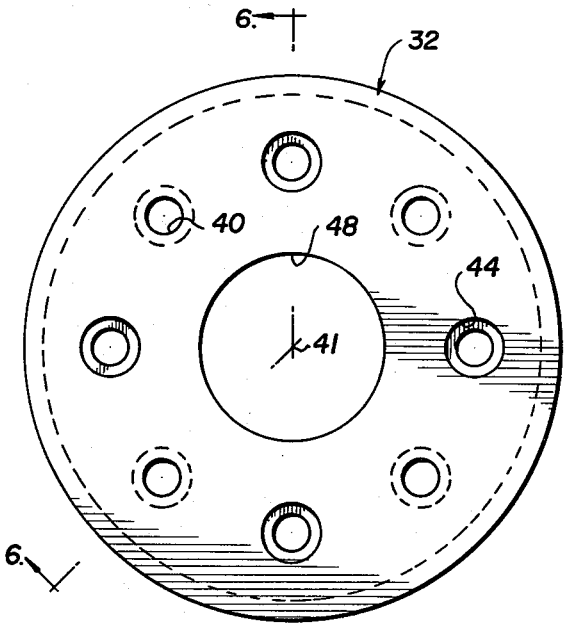
FIG. 5
FIG. 6
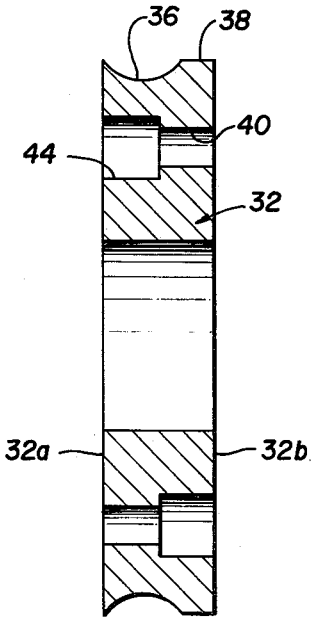

COMPOSITE PINCH ROLL FOR CONTINUOUS VERTICAL CASTING

BACKGROUND OF INVENTION

Conventional or commercial continuous vertical casting operations are capable of casting either a single bar or a pair of bars.

As the bars are cast through a mold or die, the bars are drawn downwardly through opposed pinch rolls which engage opposite side portions of the bar, with the pinch rolls rotating about horizontal axes. In many installations, it is conventional to use upper and lower sets of pinch roll assemblies to draw the cast bar downwardly along a predetermined vertical path.

Single bar casting operations are often utilized for larger size bars (for example, up to ten inches in diameter) since there is insufficient room when utilizing conventional size crucibles, for accommodating two relatively large size bars. Although smaller size bars (up to three inches in diameter) may be cast in tandem ("double bar" or "twin strand" casting) utilizing conventional size crucibles, it is necessary to prolong stoppage of the casting operation in order to change crucibles or change or adjust pinch rolls when converting from a single bar casting operation to a double bar casting operation or vice versa. In addition, adjustment of the pinch rolls can become even more time consuming when it is necessary to relocate the pinch rolls in each assembly for casting along different casting lines, depending on the size of the crucible, in a double bar casting operation. The casting line is the vertical axis along which the bar is cast. Due to size limitations of two types of crucibles (round or flat bottom crucibles) commonly used in industry, the bars in double bar casting operations, must be cast along five or six inch spaced casting lines depending on the type of crucible used.

OBJECTS OF INVENTION

It is a primary object of the present invention to provide an improved pinch roll capable of handling relatively large or small size bars cast in a continuous vertical casting operation.

It is a further object of the present invention to provide an improved pinch roll which may be utilized in a single or double bar vertical continuous casting operation without requiring repositioning of the pinch roll and without requiring a change in crucibles in order to accommodate the size requirements of double bar casting. Included herein is such a pinch roll that may be utilized with conventional casting apparatus, including conventional size crucibles utilized to hold and pour molten metal from which the bar is cast.

Another object of the present invention is to provide such a pinch roll as described above which may be easily adjusted to permit it to be utilized in different casting set-ups, depending on the size of the crucible or the spacing between the lines along which the bars are cast in a double bar casting operation.

SUMMARY OF INVENTION

In accordance with the invention and by way of summary, the pinch roll includes a main body portion and opposite side portions which are removably secured to opposite sides of the main body portion in one of two alternate positions depending on the distance between the casting lines in a double bar casting operation. The main body portion has a concave peripheral surface (which may be termed "the bar contacting surface") with a radius of curvature for accommodating bars of various sizes to be cast. The main body portion is used in a single bar casting operation and will accommodate bars of relatively large diameters.

The opposite side portions of the pinch roll are each provided with concave peripheral surfaces (which may also be termed "bar contacting surfaces") for engaging and drawing bars in a double bar casting operation. The distance between the above contacting surfaces of the side portions of the pinch roll corresponds to the distance between the casting lines in a double bar casting operation. In order to change the distance between the bar contacting surfaces, each side portion of the pinch roll is formed with a peripheral land adjacent the bar contacting surface thereof. When the side portion of the pinch roll is fixed to the main body portion of the pinch roll with the land located adjacent the main body portion, the distance between the casting lines will be greater than when the side portions are fixed to the main body portions in the opposite manner, that is, with the bar contacting surfaces of the side portions of the pinch roll located adjacent the main body portion.

The side portions of the pinch roll may be fixed to the main body portion in any suitable manner, such as, by bolts received in passages aligned in the side portions and main body portion. The main body and side portions of the pinch roll are provided with central passages for mounting them on a shaft for rotation.

DRAWINGS

Other objects and advantages of the present invention will become apparent from the following more detailed description of the invention taken in conjunction with the attached drawings in which:

FIG. 3 is a plan view of one of the pinch roll assemblies as used in a double bar casting operation;

FIG. 4 is a view generally similar to FIG. 3 except that the pinch rolls have been adjusted to accommodate a different, lesser spacing, between the double bars being cast;

FIG. 5 is an enlarged side elevational view of one of opposite side portions of one of the pinch rolls; and FIG. 6 is a cross-sectional view taken generally along line 6—6 of FIG. 5.

DETAILED DESCRIPTION

Figure 1:
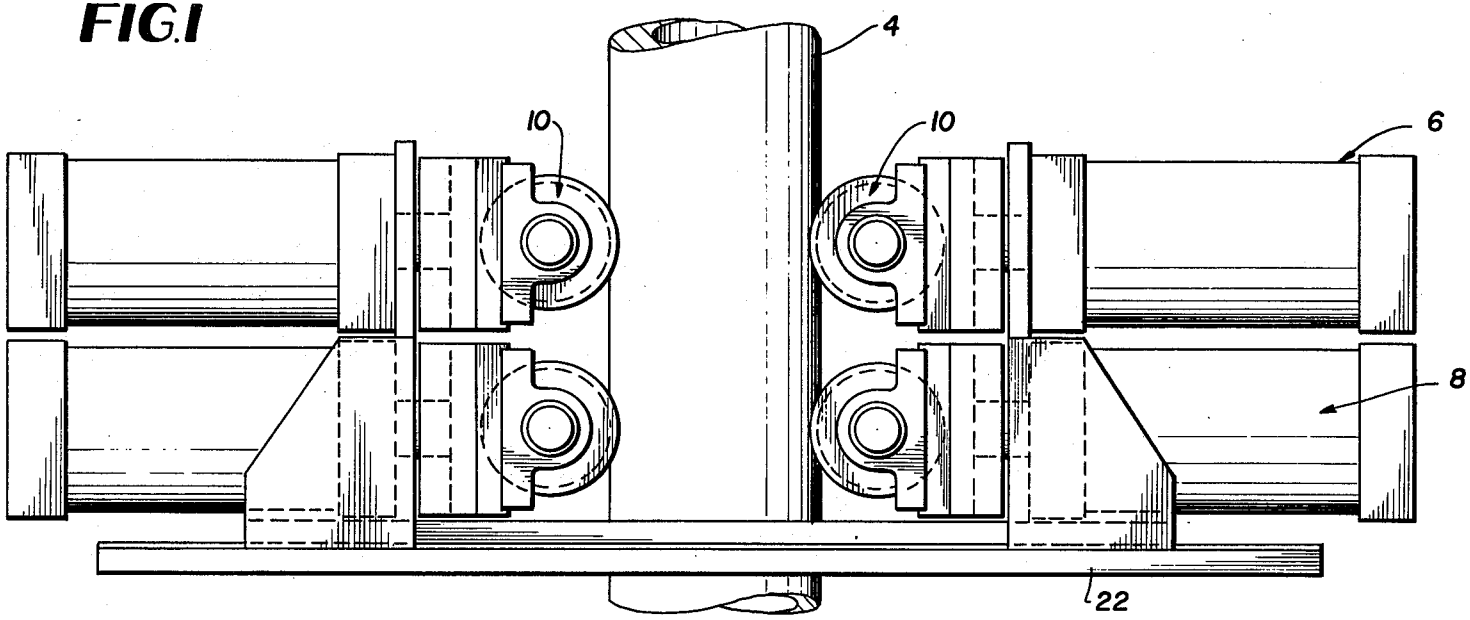
FIG. 1 is a side elevational view of pinch roll assemblies included in apparatus (not shown) for continuous vertical casting, the pinch roll in each of the assemblies being constructed in accordance with the present invention and the assemblies being shown in a single bar casting operation.
Figure 2:
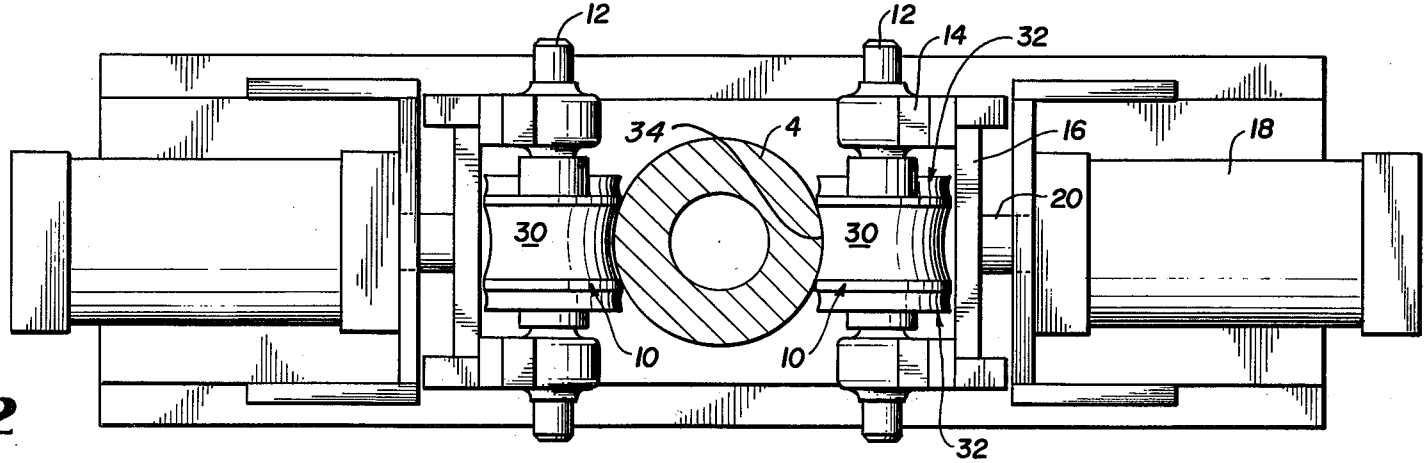
FIG. 2 is a plan view of the apparatus shown in FIG. 1.

Referring now to the drawings in detail and initially FIGS. 1 and 2, there is shown for illustrative purposes only upper and lower pinch roll assemblies 6 and 8 included in continuous vertical bar casting apparatus for engaging and drawing downwardly bars generally designated 4 (one shown) after they emerge from the die or molds. One such casting apparatus including a die assembly with a cooler and a crucible containing molten metal to be cast is shown, for example, in my U.S. Pat. No. 4,000,773, entitled "Die Assembly For Continuous Vertical Casting Of Tubular Metallic Products" and issued Jan. 4, 1977. Reference to this patent may be had for disclosure of one particular vertical casting apparatus; it being understood that the die assembly forms no part of the present invention. Bar 4 upon casting, is engaged and drawn downwardly by pinch roll assemblies, there being shown in FIG. 1 upper and lower sets of pinch roll assemblies 6 and 8 respectively. As shown in FIG. 2, each pinch roll assembly includes opposed pinch rolls 10 which engage the opposite sides of the cast bar 4 to draw it downwardly subsequent to its casting by the die assembly (not shown). Each pinch roll 10 is mounted for rotation on a shaft 12 journaled in pillow blocks 14 which, in turn, are secured to a cross member 16 for actuation towards or away from the path of the bar 4 by means of hydraulic cylinders 18; the latter being connected to the cross member 16 by shaft 20, as shown in FIG. 2. Cylinders 18 are mounted to any suitable support received on a base generally designated 22 in FIG. 1.

Each pinch roll 10 includes a main body portion generally designated 30 having a generally cylindrical shape but preferably including a concave continuous peripheral surface portion generally designated 34 for engaging the bar 4 as shown in FIG. 2. Extending across bar contacting surface 34 of the main body portion 30 of the pinch roll in the preferred embodiment, are a plurality of circumferentially spaced transverse serrations 31 as shown in FIG. 3. In one specific form, the serrations 31 are about 0.025 inches deep with the sides of each serration extending at about ninety degrees (90°) relative to each other for purposes of enhancing contact with the bar 4. The opposite side surfaces 30*a* of the main body portion 30 are flat and parallel to each other and in the preferred embodiment, the perpendicular distance between these surfaces (or the width of the main body portion) is four inches.

As shown in FIG. 2, each pinch roll 10 further includes opposite, disc-like, side portions generally designated 32, removably fixed to the opposite sides 30*a* of the main body portion 30. As best shown in FIG. 6, side pieces 32 have opposite flat side faces 32*a* and 32*b* which are parallel to each other. Each of the side portions 32 of the pinch roll includes a peripheral bar contacting surface 36 also having a concave shape for purposes of engaging a bar 4 such as in a double bar casting operation illustrated in FIG. 3, wherein two bars 4 are being simultaneously cast and drawn downwardly under the guidance of the concave surfaces 36 of the opposite side portions of the pinch rolls. It should be noted that in a double bar casting operation, the upper pinch roll assemblies are used to draw one bar and the lower pinch roll assemblies are used to draw the other bar. Portions of the lower pinch roll assemblies are shown in phantom lines in FIGS. 3 and 4.

Side portions 32 of the pinch rolls each further include a peripheral circular land located on one side of the bar contacting surface 36. In the position shown in FIG. 3, the side portions 32 of the pinch roll are fixed to the main body portion 30 with the land 38 contacting or adjacent the main body portion 30, thereby spacing the bar contacting surfaces 36 outwardly from the land 38 opposite the main body portion 30. Inasmuch as the land is one-half inch wide and the bar contacting surfaces 36 each one inch wide, the distance between the cast lines shown in plan as CL in FIG. 3, will be six inches in the specific embodiment which includes a four inch wide main body portion 30. This distance of six inches corresponds to one setting that can be made in order to work in connunction with one conventional size crucible.

In another type of crucible where the casting lines in a double bar casting operation are spaced five inches from each other, the opposite side portions 32 are simply removed from the main body portion 30 and reversed and then resecured to place them into the position shown in FIG. 4. In the latter position, the bar contacting surfaces 36 have been moved closer together so that the distance between the casting lines CL is five inches.

Any suitable means may be utilized in order to removably secure the side pieces 32 to the main body portion 30. In the preferred embodiment shown, a plurality of passages 40 there being eight shown, are formed transversely through the side pieces 32 as shown in FIG. 5, at distances spaced equiangularly about the center 41 of the side piece 32 as shown in FIG. 5. Corresponding passages with threads (not shown) are provided in the main body portion 30 so that bolt fasteners may be inserted through passages 40 in the side pieces 32 and into the corresponding passages in the main body portion 30. It is further preferred that four of the passages 40 be counterbored as shown at 44 (FIGS. 5 and 6) on one side of the side piece 32 as shown in FIG. 5 and that the remaining four passages 40 be counterbored on the opposite side of the side piece. Thus, in securing side pieces 32 to main body portion 30, four bolts may be utilized in the passages 40 whose counterbored portions 44 are externally positioned.

As noted above, the pinch roll 10 is mounted on a shaft 12 and, for this purpose, side pieces 32 are provided with central passages 48, together with similar coaxial central passages in the main body portion 30. It is also preferred that the peripheral bar contacting surface 36 of each of the side pieces 32 be provided with transverse circumferentially spaced serrations similar to those utilized in the main body portion 30.

In use, the pinch rolls of the present invention may be utilized with conventional crucibles to draw or guide a single bar 4 such as shown in FIG. 2 wherein the main body portion 30 of the pinch roll functions to engage the bar 4. If it is desired to convert to a double bar casting operation where, for example, the distance between the casting lines is to be six inches, the opposite side portions 32 are secured to the main body portion in the position shown in FIG. 3. If, on the other hand, the crucible being utilized in the double bar casting operation requires that the casting lines be spaced five inches from each other, the side pieces 32 are removed from the main body portion 30 and reversed to position them as shown in FIG. 4 which will space the centers of bar contacting surfaces 36 a distance of five inches.

In addition to the advantages noted above, the pinch roll of the present invention also permits either of its side portions 32 to be easily replaced should they become damaged or should another side piece having a larger or smaller size, be required. This change is done without changing the main body portion. It should be understood that the specific dimensions of the side portions 32 described above, as well as the main body portion 30, are preferred and that other size combinations of main body portion and side portions may be utilized depending upon the size of the bars to be cast and/or the size of the crucibles utilized in the casting operation. In one embodiment, the concave contacting surface 34 of the main body portion of the pinch roll has a radius of curvature of approximately five inches, and the bar contacting surface 36 of the side portions has a radius of curvature of approximately one and one-half inches. In this manner, larger size bars up to ten inches in diameter can be accommodated in a single bar casting operation, and smaller size bars up to three inches in diameter can be accommodated in double bar casing operations.

I claim:

1. A pinch roll for use in a continuous vertical casting operation, the pinch roll comprising, a main body portion having a peripheral surface for engaging a bar to be cast, and a pair of opposite side portions removably fixed to the main body portion, each side portion having a peripheral bar contacting surface for engaging a bar in a double bar casting operation, said side portions each having a peripheral land located on one side of their peripheral bar contacting surfaces such that the distance between their peripheral bar contacting surfaces may be varied depending on whether the side portions are fixed to the main body portion in one position with the lands located adjacent the main body portion or in an alternative position, with the peripheral bar contacting surfaces located adjacent the main body portion.

2. The pinch roll defined in claim 1 wherein the bar contacting surfaces of the side portions are concave.

3. The pinch roll defined in claim 2 wherein the distance between the centers of the peripheral bar contacting surfaces of the side pieces is approximately six inches when the side portions are in said one position and five inches when said side portions are in said alternative position.

4. The pinch roll defined in claim 2 wherein the peripheral bar contacting surface of the main body portion is concave.

5. The pinch roll defined in claim 3 wherein the peripheral bar contacting surface of the main body portion is concave with a radius of curvature of approximately five inches.

6. The pinch roll defined in claim 5 wherein the peripheral bar contacting surface of the side portions each have a radius of curvature of approximately one and one-half inches.

7. The pinch roll defined in claim 1 wherein said main body portion and said side portions have aligned passages extending transversely therethrough and there is included fasteners extending through said passages removably securing said portions together in one of said positions thereof.

8. The pinch roll defined in claim 1 wherein said main body portion has a generally cylindrical configuration with opposite flat side surfaces and wherein said side portions of the pinch roll have a generally disc-like configuration with opposite flat surfaces engageable with the flat surfaces of the main body portion, respectively and wherein said main body portion and said side portions have central passages for mounting them on a shaft.

9. The pinch roll defined in claim 4 wherein the radius of concavity of the main body portion is greater than that of each of the side portions.

10. The pinch roll defined in claim 1 wherein said peripheral bar contacting surfaces of the opposite side portions of the pinch roll have transverse serrations spaced circumferentially throughout for enhancing engagement with the bar to be cast.

11. A pinch roll for use in a continuous vertical casting operation, the pinch roll comprising, a main body portion having a peripheral surface for engaging a bar to be cast, and a side portion removably fixed to the main body portion, said side portion having a peripheral bar contacting surface for engaging a bar in a double bar casting operation, said side portion having a peripheral land located on one side of said peripheral bar contacting surface such that the side portion may be fixed to the main body portion in one position with the land located adjacent the main body portion or in an alternative position, with the peripheral bar contacting surface located adjacent the main body portion.

* * * * *